US005394632A

United States Patent [19]

Gebka et al.

[11] Patent Number: 5,394,632

[45] Date of Patent: Mar. 7, 1995

[54] PRICE CHANNEL

[75] Inventors: John Gebka, Chicago Heights, Ill.; Michael E. Brinkman, Raleigh, N.C.

[73] Assignee: FEMC Ltd., Ft. Lauderdale, Fla.

[21] Appl. No.: 45,438

[22] Filed: Apr. 9, 1993

[51] Int. Cl.[6] ..... G09F 13/00

[52] U.S. Cl. ..... 40/642; 40/649

[58] Field of Search ..... 40/642, 661, 649

[56] References Cited

U.S. PATENT DOCUMENTS

| | | | |
|---|---|---|---|
| 2,626,472 | 1/1953 | Stingl | 40/650 |
| 4,334,372 | 6/1982 | Colmar | 40/649 |
| 4,483,502 | 11/1984 | Fast . | |
| 4,485,575 | 12/1984 | Fast . | |
| 4,497,464 | 6/1985 | Fast . | |
| 4,531,313 | 7/1985 | Fast . | |
| 4,532,726 | 8/1985 | Kenney | 40/642 |
| 4,564,548 | 1/1986 | Fast . | |
| 4,718,627 | 1/1988 | Fast et al. . | |

FOREIGN PATENT DOCUMENTS

| | | | |
|---|---|---|---|
| 511468 | 11/1992 | European Pat. Off. | 40/642 |
| 3900904 | 2/1990 | Germany | 40/642 |

OTHER PUBLICATIONS

AFI Disclosure, Apr. 19, 1991.

Bentler Disclosure.

*Primary Examiner*—Kenneth J. Dorner

*Assistant Examiner*—Cassandra Davis

*Attorney, Agent, or Firm*—Jacobson, Price, Holman & Stern

[57] ABSTRACT

An extruded plastic price channel can be fitted in a C-channel at the front of a merchandise shelf to provide a mounting for merchandise labelling. The price channel includes a label panel and a leg extending from the back of the label panel. A top edge of the label panel and a free end of the leg snap behind upper and lower lips of the C-channel to retain the price channel in place with the label panel angled to the vertical. The top edge of the label panel has an improved design to enhance its grip in the C-channel. The price channel may also include a transparent co-extruded cover for the front of the label panel to retain non-adhesive labels.

8 Claims, 4 Drawing Sheets

PRICE CHANNEL

BACKGROUND OF THE INVENTION

This invention relates to price channels of the kind frequently used at the front of merchandise shelves in supermarkets and the like for attaching pricing labels, or signs pertaining to the merchandise on the shelves.

Steel merchandise shelves frequently are made with a C-shaped channel along the front edge in which labels or sign holders can be fitted. Where such shelves are formed without a channel, plastic fittings can be added to the shelves to provide such channels. Price channels can generally be used to accommodate snap-in price labels and sign holders or smaller adhesive backed labels.

When price channels are used, as above, for labelling merchandise on a shelf, no significant problems arise for shelves which are at a convenient viewing height for a customer. For shelves near floor level, however, and shelves above eye level, customers have trouble in reading price channel labels because the labels are generally vertically oriented. One known form of extruded plastic snap-in price channel 10, as shown in FIGS. 1 and 2 provides labelling panel 12 oriented at an angle when the price channel is fitted on a shelf, so that when used on a floor level shelf, a label is more readily viewed by a customer. The known price channel includes a rearwardly extending leg 14 and a projecting barb 16 at the top of the labelling panel. When snapped into an existing C-channel of a metal shelf 18, the barb engages behind the upper lip 20 of the C-channel, the bottom of leg 14 engages behind the lower lip 22, and the labelling panel is angled upwardly. It has been found, however, that the known snap-in price channel 10, can be displaced somewhat easily from the C-channel, for example, when bumped by a shopping cart.

Also, as evident in FIGS. 1 and 2, price channel 10 is provided with a co-extruded clear plastic front cover 24 providing a means whereby non-adhesive labels can be retained against the labelling panel. The bulbous nature of the bottom end of the price channel destroys the gripping effect of this end so that the price channels as illustrated cannot be used to receive snap-in sign holders, for example.

SUMMARY OF THE INVENTION

It is an object of the invention to provide a plastic price channel of the general kind described above having an angled labelling panel, but which is less susceptible to being inadvertently knocked out of position from a shelf on which it is mounted.

Another object of the invention is to provide a price channel as aforesaid which, in one of its embodiments, includes a cover for the labelling panel, so that the price channel can be used to receive small size non-adhesive labels, and which is constructed so that it can also receive snap-in sign holders and the like.

In fulfillment of the above and other objects, a price channel according to the invention has a generally similar structure to the known price channels previously described. The barb at the upper end of the labelling panel however is redesigned to provide the price channel with a better grip in a C-channel on the front of a shelf and preclude the price channel from being so readily knocked out of position.

Also, in an embodiment of the invention wherein the price channel includes a co-extruded cover, the lower edge of the cover joins the labelling panel inside of a concave lip at the bottom of the labelling panel, whereby the integrity of the lip is maintained outwardly of the cover and it can be used to grip a snap-in sign holder or the like over the cover. Additional features and advantages of the invention will become apparent from the ensuing description and claims read in conjunction with the attached drawings.

DESCRIPTION OF PREFERRED EMBODIMENTS

Figure 1:
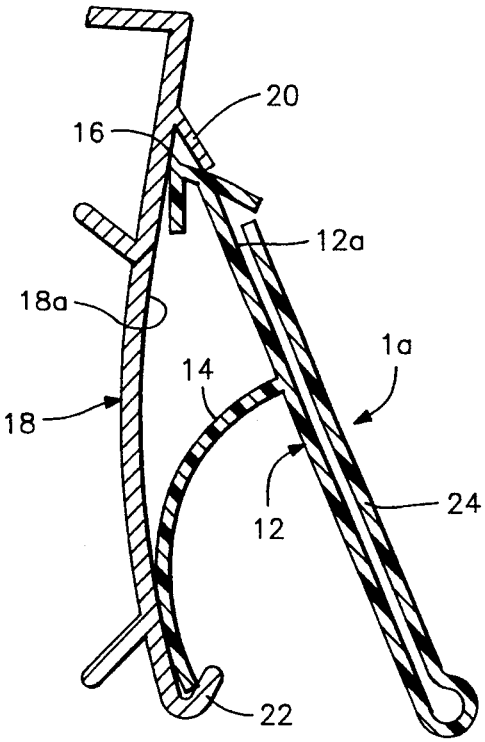
FIG. 1 (PRIOR ART)
FIG. 1 is a sectional elevational view of a known plastic price channel fitted into a C-channel of a metal shelf for the display of merchandise in a supermarket or the like, FIG. 2 is a sectional elevational view of the known price channel removed from the shelf.
Figure 3:
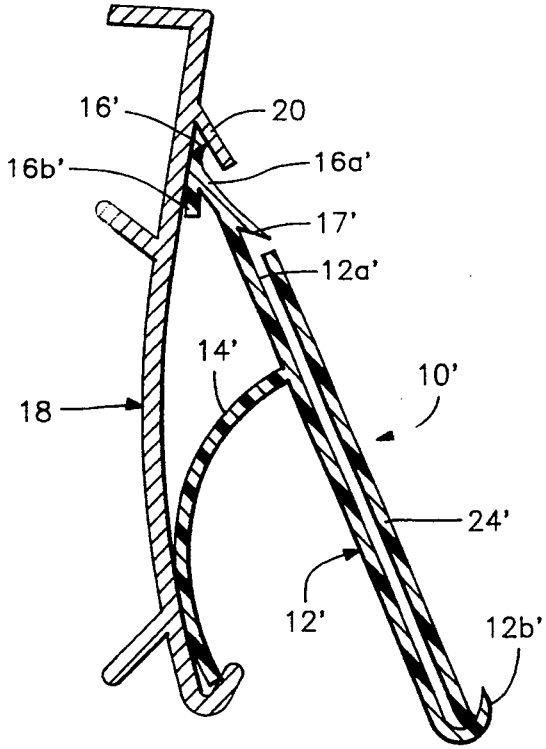
FIGS. 3 and 4 are views similar to FIGS. 1 and 2 but of a plastic price channel made in accordance with the invention.
Figure 2:
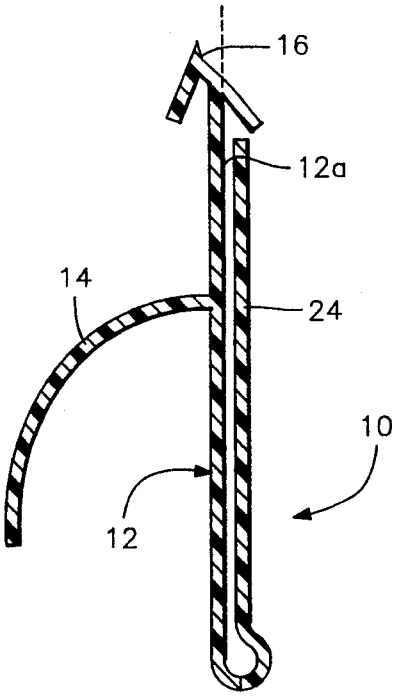
FIG. 2 (PRIOR ART)
Figure 4:
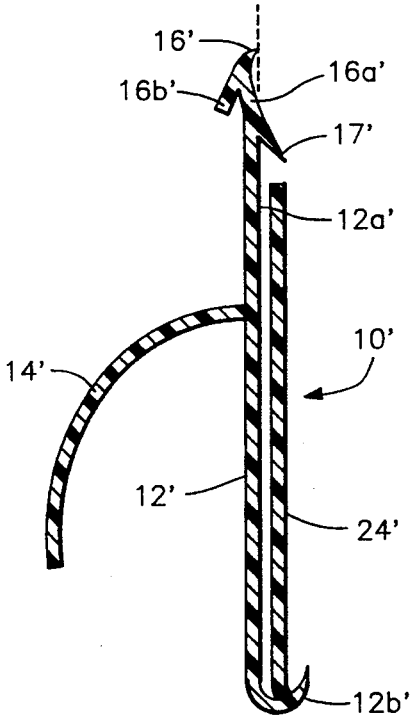

An extruded plastic price channel 10' according to the invention, as shown in FIGS. 3 and 4, is generally similar in overall design and concept to the known price channel 10 shown in FIGS. 1 and 2, and like reference numerals (primed) are used to denote like parts. There are significant differences, however in the respective barbs 16 and 16' and in the location of the respective transparent covers 24 and 24'.

Reverting to the known price channel 10, as noted above, this is susceptible to being displaced from the position on a shelf as shown in FIG. 1, for example by being bumped by a shopping cart. This may be attributable to the fact that in the known structure, the point or tip of the barb 16 is located rearwardly of the front face **12*a* of panel 12, (see dotted line,) so that when attached to the shelf 18, the barb exerts pressure rearwardly against the front face 18*a*** of the shelf.

By contrast, according to the invention, the barb 16' is designed to exert forward pressure against the back of lip 20 of shelf 18 which provides more secure attachment to the shelf to preclude the price channel from being so readily displaced if bumped by a shopping cart, for example. To this end, the tip of barb 16' should be at least level with the front face **12*a* of panel 12' and may extend somewhat forwardly of the front face. Extending downwardly from the top edge of the label panel is a forwardly directed lip 17'. The barb has a forwardly directed limb 16*a'* merging with lip 17' and a rearwardly directed limb 16*b'***.

Figure 5:
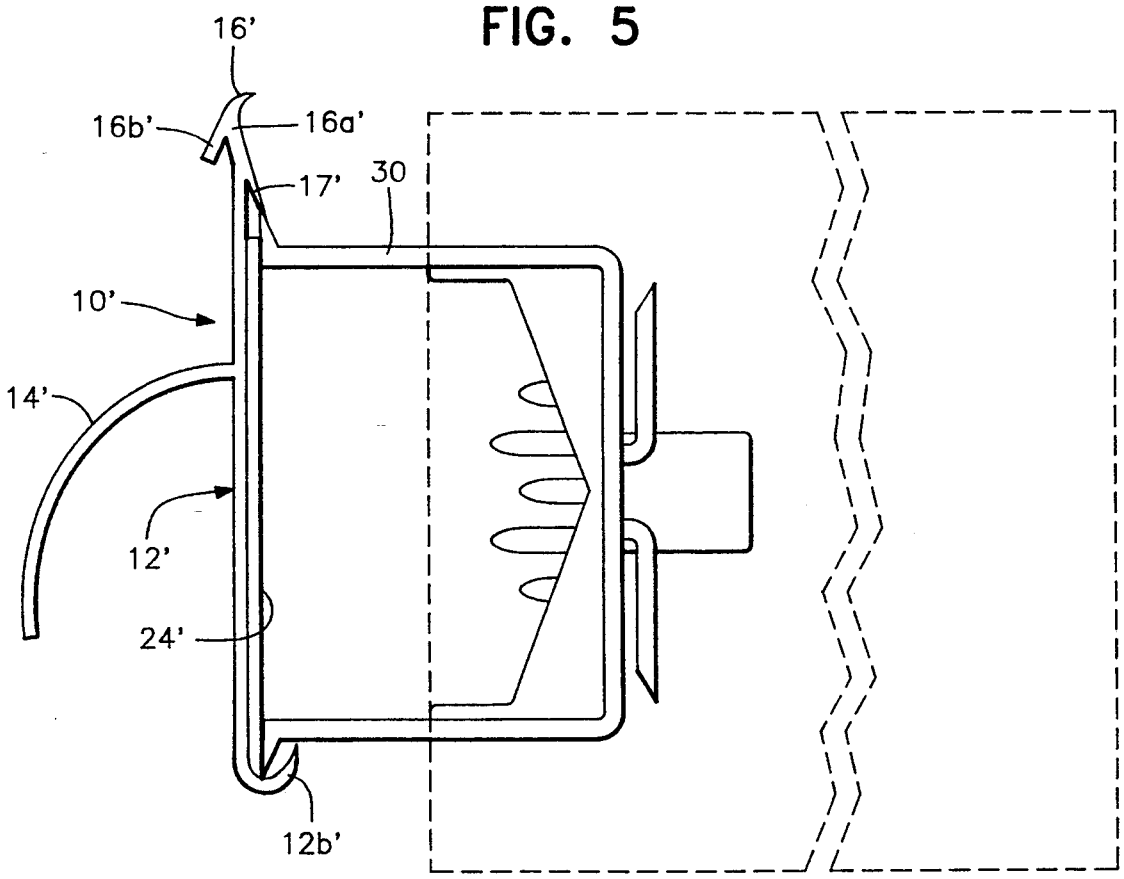
FIG. 5 is an end elevational view of the invention price channel with an attached sign holder and sign (shown in phantom)

The front panel 12' has a substantially U-shaped concave lower end with a lip **12*b'* and the transparent cover 24' is co-extruded with panel 12' so that the lower end of the cover joins the panel behind lip 12*b'*. Thus, the price channel 10' can be used not only to receive non-adhesive labels behind cover 24' but can also be used to snap-in labels or a sign holder 30 (FIG. 5) in front of cover 24' between lip 12b' and lip 17'**.

Figure 7:
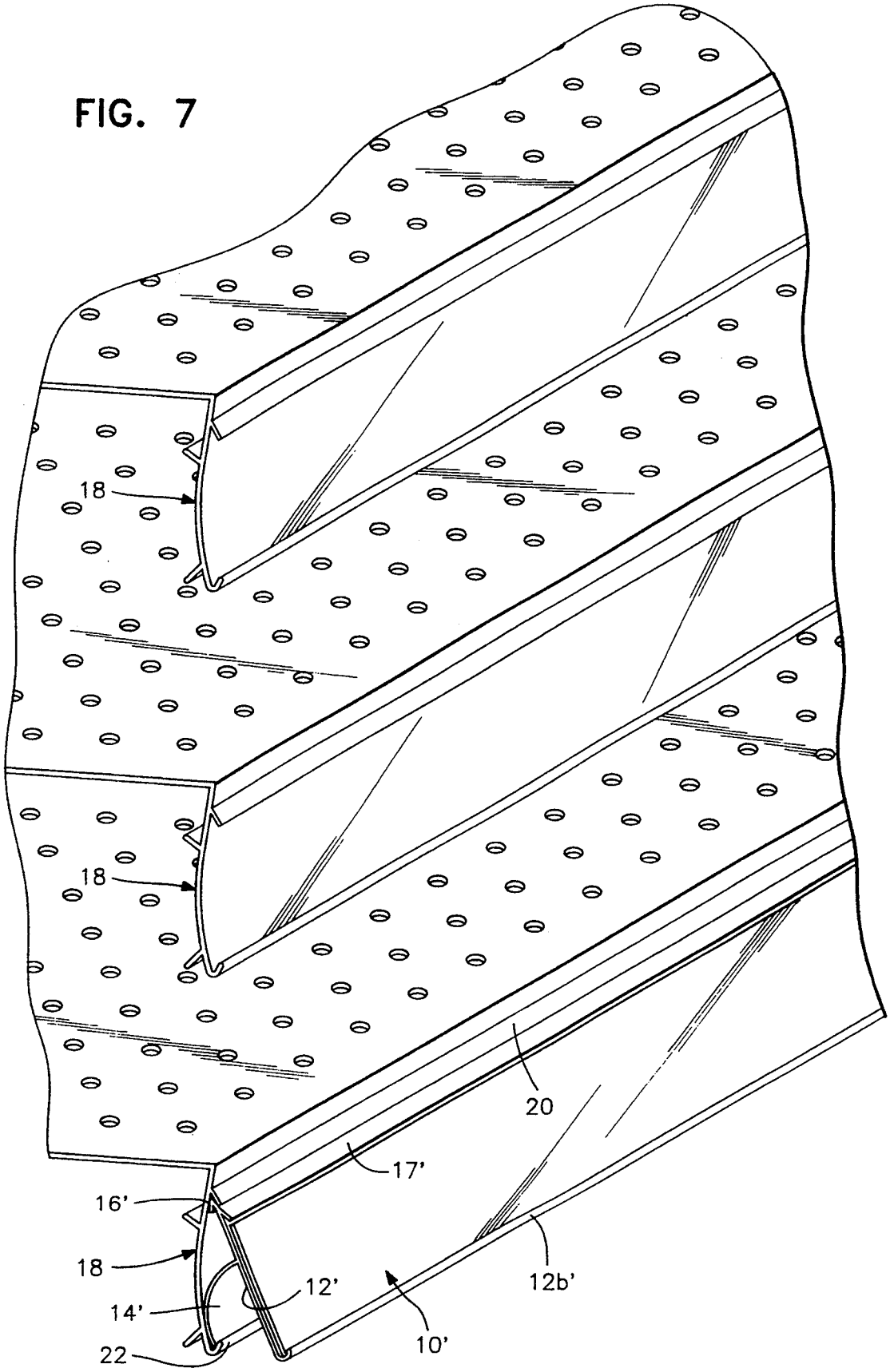
FIG. 7 is a perspective view of a set of supermarket shelves with a price-channel according to the invention attached to the lowermost shelf close to floor level.
Figure 8:
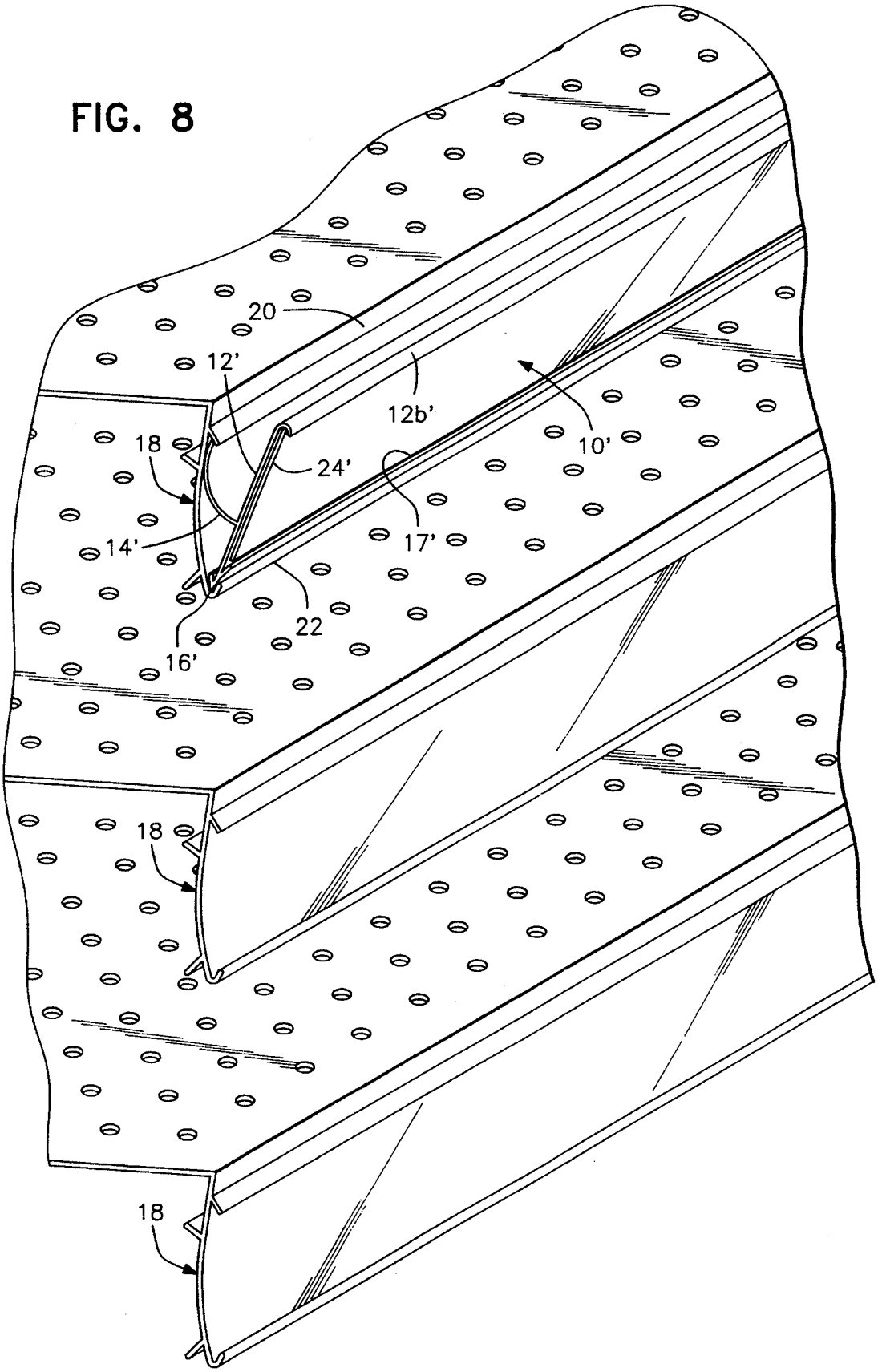
FIG. 8 is a view similar to FIG. 5 showing the price channel attached upside-down to the uppermost shelf above eye level.

FIG. 7 shows price channel 10' used on a lowermost shelf 18 at or near floor level, with panel 12' angled upwardly to facilitate viewing. FIG. 8 shows the price channel used upside down on an upper shelf, above eye level, with panel 12' angled downwardly to facilitate viewing.

Figure 6:
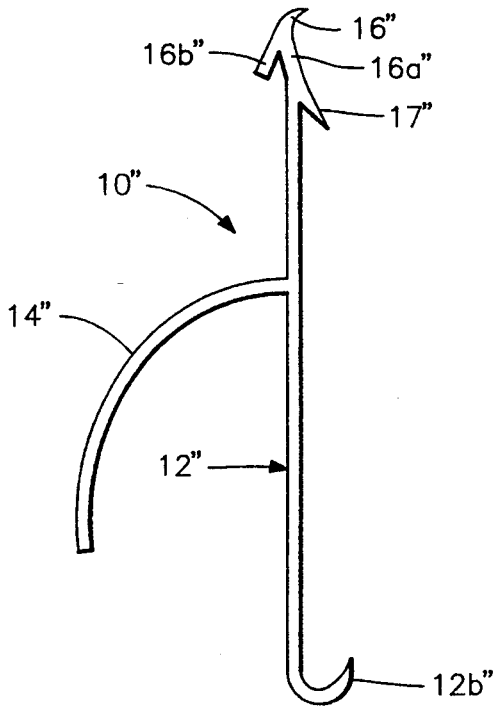
FIG. 6 is an end elevational view of a modified price channel according to the invention.

The modified form of price channel 10'' shown in FIG. 6 is similar in all respects to price channel 10' except that cover 24' has been omitted. Price channel 10'' can be used to receive snap-in or adhesive labels.

While only preferred embodiments of the invention have been described herein in detail, the invention is not limited thereby and modifications can be made within the scope of the attached claims.

We claim:

1. A plastic price channel for use on a merchandise shelf comprising a label panel having a front surface and a back surface, a first forwardly directed lip formed along one longitudinal edge of the label panel and extending towards an opposite longitudinal edge of the panel, a second forwardly directed lip formed along said opposite longitudinal edge and extending towards said one longitudinal edge of the panel, a projecting barb extending along said one longitudinal edge of the panel, said barb having a tip located at least as far forwardly of the channel as said front surface of the label panel, and a leg extending from the back surface of the label panel towards said opposite longitudinal edge of the label panel.

2. A price channel as claimed in claim 1, wherein the barb includes a rearwardly directed limb and a forwardly directed limb merging with said first lip.

3. A price channel as claimed in claim 1, wherein the label panel has a concave portion at said opposite longitudinal edge terminating in said second forwardly directed lip and wherein the price channel further includes a see-through cover extending over the front surface of the label panel, the cover having one longitudinal edge attached to the label panel within said concave portion behind said second lip.

4. In combination with a merchandise shelf having a front edge formed as a C-shaped channel with an upper lip and a lower lip, a plastic price channel received in said C-shaped channel, the price channel having a label panel with a front surface and a back surface, a first forwardly directed lip formed along one longitudinal edge of the label panel and extending towards an opposite longitudinal edge of the label panel, a second forwardly directed lip formed along said opposite edge of the label panel and extending towards said one longitudinal edge, a projecting barb extending along said one longitudinal edge of the label panel, and a leg extending from the back surface of the label panel towards said opposite longitudinal edge, the price channel being fitted in said C-shaped channel with said barb being received behind one of said upper and lower lips of the C-shaped channel and with a tip of the barb exerting forward pressure against said one of said upper and lower lips of the C-shaped channel, with a free end of said leg being received behind the other of said upper and lower lips of the C-shaped channel, and with said label panel oriented at an angle to a vertical plane.

5. A combination as claimed in claim 4, wherein the barb includes a rearwardly directed limb and a forwardly directed limb merging with said first forwardly directed lip.

6. A combination as claimed in claim 4, wherein the label panel has a concave portion at said opposite longitudinal edge terminating in said second forwardly directed lip and wherein the price channel further includes a see-through cover extending along the front surface of the label panel, the cover having one longitudinal edge attached to the label panel within said concave portion behind said second lip.

7. A plastic price channel for use on a merchandise shelf comprising a label panel having a front surface and a back surface, a first forwardly directed lip formed along one longitudinal edge of the panel and extending towards an opposite longitudinal edge of the panel, a concave portion at said opposite longitudinal edge of the panel terminating in a second forwardly directed lip extending towards said one longitudinal edge of the panel, a see-through cover extending over the front surface of the label panel, the cover having one longitudinal edge attached to the label panel within said concave portion behind the second lip and a second plane longitudinal edge adjacent the first lip whereby a label can be held in the price channel between said lips behind or forwardly of the cover and a projecting barb extending along said one longitudinal edge of the panel, said barb having a tip located at least as far forwardly of the price channel as said front surface of the label panel.

8. A price channel as claimed in claim 7, which includes a leg extending from the back surface of the label panel towards said opposite longitudinal edge of the label panel.

* * * * *